US009359697B2

(12) United States Patent
Duncan

(10) Patent No.: US 9,359,697 B2
(45) Date of Patent: Jun. 7, 2016

(54) ADJUSTABLE SPINNING WHEEL

(71) Applicant: Beth Duncan, Plainfield, IN (US)

(72) Inventor: Beth Duncan, Plainfield, IN (US)

( * ) Notice: Subject to any disclaimer, the term of this patent is extended or adjusted under 35 U.S.C. 154(b) by 6 days.

(21) Appl. No.: 14/488,826

(22) Filed: Sep. 17, 2014

(65) Prior Publication Data

US 2016/0076172 A1 Mar. 17, 2016

(51) Int. Cl.
*D01H 3/00* (2006.01)

(52) U.S. Cl.
CPC ..... *D01H 3/00* (2013.01)

(58) Field of Classification Search
CPC ..... D01H 3/00; D01H 3/02
USPC ..... 57/316
See application file for complete search history.

(56) References Cited

U.S. PATENT DOCUMENTS

| | | | | | |
|---|---|---|---|---|---|
| 42,661 | A * | 5/1864 | Hotchkiss | D01H 3/00 | 57/316 |
| 62,351 | A * | 2/1867 | Matheny | D01H 3/00 | 57/316 |
| 69,387 | A * | 10/1867 | Barnes | D01H 3/00 | 57/316 |
| 129,459 | A * | 7/1872 | Cochran | D01H 3/00 | 57/316 |
| 147,200 | A * | 2/1874 | Voegtli | D01H 3/00 | 57/316 |
| 193,562 | A * | 7/1877 | Smith et al. | D01H 3/00 | 57/316 |
| 224,700 | A * | 2/1880 | Keisling et al. | D01H 3/00 | 57/316 |
| 227,873 | A * | 5/1880 | Allen | D01H 3/00 | 57/316 |
| 229,093 | A * | 6/1880 | Church | D01H 3/00 | 57/316 |
| 246,251 | A * | 8/1881 | Voegtli | D01H 3/00 | 57/316 |
| 467,654 | A * | 1/1892 | Lotz | D01H 3/00 | 57/316 |
| 580,452 | A * | 4/1897 | Engel | D01H 3/00 | 242/484 |
| 3,796,033 | A * | 3/1974 | Oliver | D01H 3/00 | 57/103 |
| 4,445,324 | A * | 5/1984 | Watkinson | D01H 3/00 | 57/316 |
| 4,458,474 | A * | 7/1984 | Lee | D01H 3/00 | 57/316 |
| 4,762,285 | A * | 8/1988 | Allred | B65H 54/106 | 242/486.9 |
| 7,472,537 | B2 * | 1/2009 | Brunk | D01H 1/00 | 57/130 |
| 2008/0127624 | A1 * | 6/2008 | Brunk | D01H 1/00 | 57/88 |

* cited by examiner

*Primary Examiner* — Shaun R Hurley
(74) *Attorney, Agent, or Firm* — C. John Brannon; Brannon Sowers & Cracraft PC

(57) ABSTRACT

A spinning wheel assembly, including a collapsible frame and a spinning assembly connectable thereto. The spinning assembly includes a first grooved pulley and a plurality of differently sized second grooved pulleys, each pulley being rotatably connectable to the frame. A spindle is removably connectable to a respective grooved second pulley, and an endless belt is operationally connected to the first and second pulleys. Each respective grooved second pulley has at least one circumferential groove defining an effective diameter and at least one unique effective diameter.

15 Claims, 2 Drawing Sheets

ADJUSTABLE SPINNING WHEEL

TECHNICAL FIELD OF THE INVENTION

The present invention relates generally to mechanical arts, and, more particularly, to an adjustable spinning wheel for spinning both wide and narrow gauge yarn.

BACKGROUND OF THE INVENTION

There is a solid and growing subculture devoted to the fiber arts in general, and spinning in particular. Spinning loose fiber into yarn is an art with roots lost in antiquity. Modern practitioners use millennia-old techniques for twisting agglomerations of loose fibers, such as wool from sheep, into yarn. One very common tool for spinning fiber into yarn is the drop spindle, a simple device for manually spinning twisted fibers directly onto a spindle using gravity and rotation. Another more mechanically complex device is the spinning wheel. The spinning wheel is a tool for twisting fibers or threads together into a continuous length of yarn. Spinning wheels are typically used by one individual at a time, and are also typically powered by that individual user.

Spinning wheels produce yarn by twisting fibers together. Fibers, such as combed wool, are fed through an orifice onto a rotating bobbin. The rotation of the bobbin twists the approaching fibers together into yarn, and the yarn is collected on the rotating bobbin. The bobbin is turned by a pulley attached thereto, which is turned by the rotation of a second pulley or wheel coupled to the first pulley by an endless belt. A pair of parallel arms, each arm having a row of spaced pins extending therefrom, extend around the spindle and act to guide the yarn onto the bobbin.

Yarn can be produced in a variety of gauges or widths, ranging from skinny, thread-like yarn to thick, cable-like yarn. However, the thickness of the yarn is determined by the number of twists per unit length, which is in turn determined by the spinning wheel's drive ratio, defined by the relative diameters of the two pulleys and the distance between them. The drive ratio is a fixed property of a given spinning wheel, such that wheels designed to produce thin or skinny yarns cannot be used to produce thick or fat yarns, and vice versa.

Thus, there remains a need for an improved spinning wheel that may be used to produce thin yarn, thick yarn, and yarns in between. The present invention addresses this need.

DETAILED DESCRIPTION OF THE PREFERRED EMBODIMENTS

Figure 1:
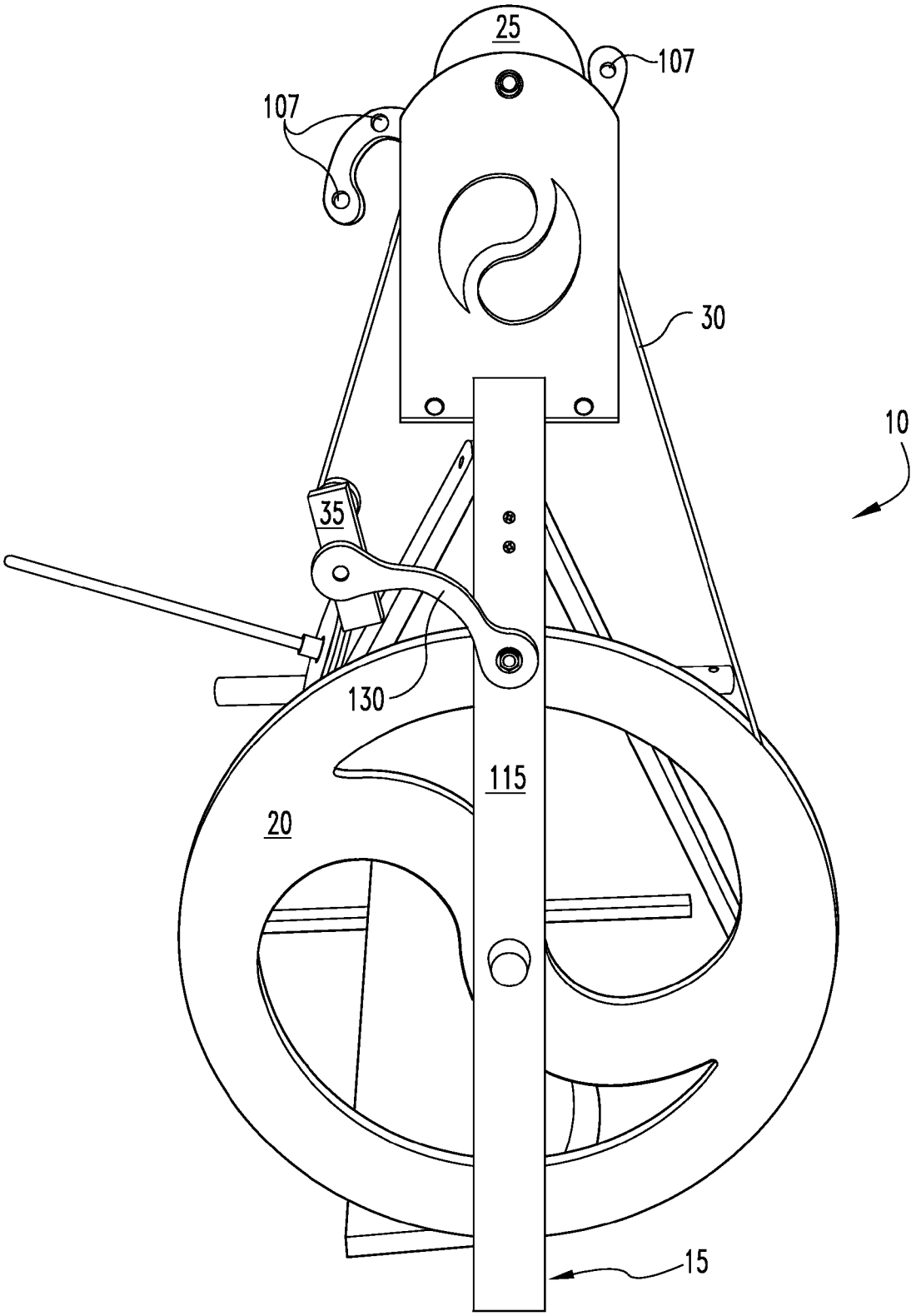
FIG. 1 is a side perspective view of a first embodiment spinning wheel assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
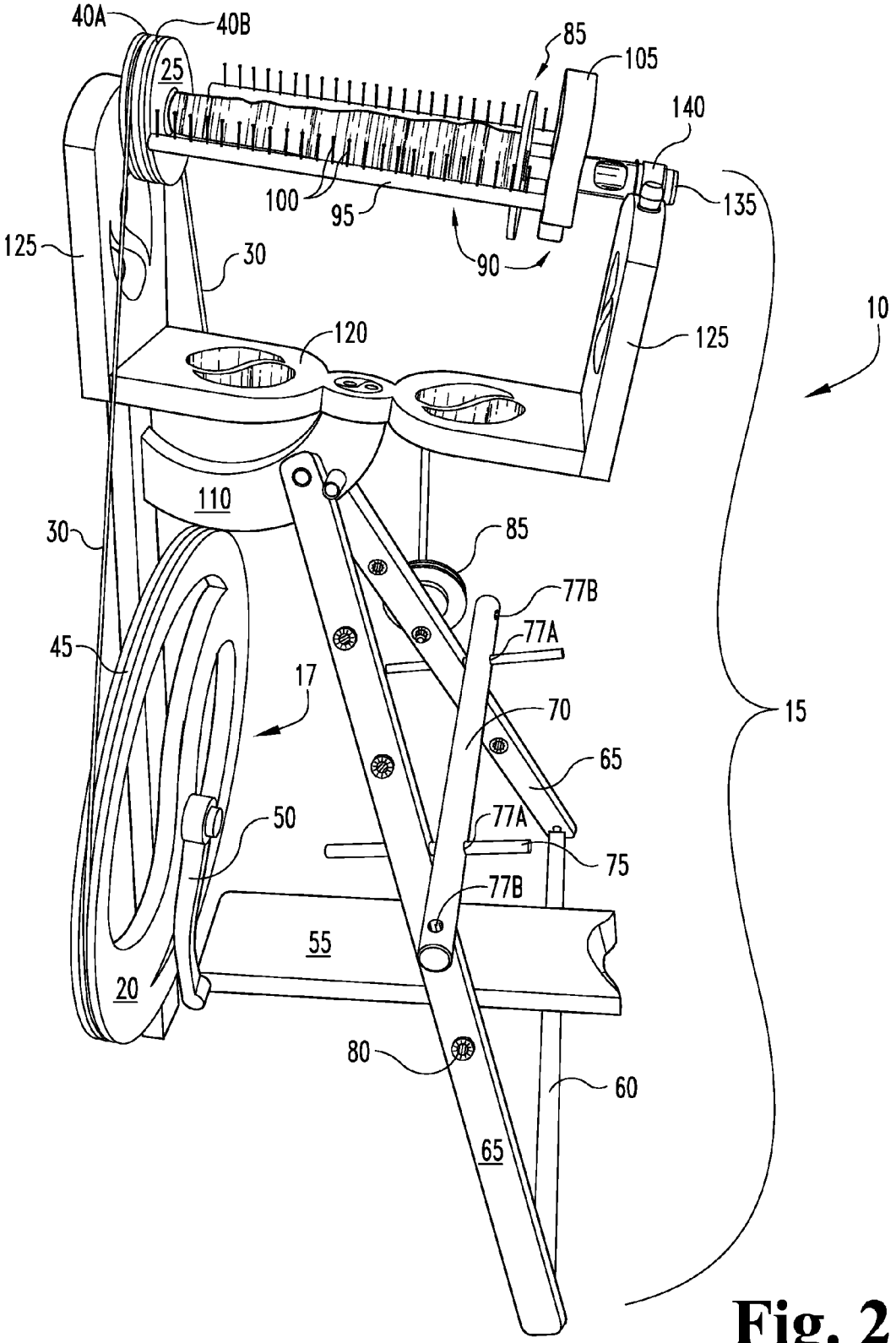
FIG. 2 is a front perspective view of the embodiment of FIG. 1.

FIGS. 1-2 relate to a first embodiment of the present invention, a spinning wheel system or assembly 10 including a collapsible frame assembly 15 to which a spinning assembly 17 is operationally connected. The spinning assembly 17 includes a first, typically larger pulley or 'drive wheel' 20 and a spaced, typically smaller, second pulley or 'whirl', both connected to the frame assembly 15. An endless belt 30 is operationally connected to the two spaced pulleys 20, 25. A tensioner 35 is typically pivotably connected to the frame assembly 15 and coupled to the endless belt 30. The second pulley 25 typically includes a first groove 40A and, more typically, a second groove 40B, operationally defining first and second functional diameters for the second pulley 25. The first pulley 20 likewise includes at least one groove 45 defining the first pulley's functional diameter.

An engagement member or 'footman' 50 is connected to the first pulley 20 and also to a pedal or 'treadle' 55. Pivoting of the pedal 55 rotates the first pulley 20 around relative to the frame assembly 15.

The frame assembly 15 includes a crossbar or 'treadle pivot support' 60 that extends below and operationally engages the pedal 55, such that the pedal is pivotable with respect to the crossbar 60. The crossbar 60 is connected at either end to a support member 65. The two support members 65 connected to the crossbar extend towards one another and are engaged by a second crossbar 70 spaced from the first crossbar 60, defining a shelf. The second crossbar 70 is typically connected to the support members 65 by respective dowels or elongated fasteners 75 extending therethrough. The second crossbar 70 has a first pair of apertures 77A for engaging fasteners to connect to support members 65, and a second pair of apertures 77B for receiving fasteners 75 to convert the crossbar 70 for use as a skein or 'niddy noddy'. The support members 65 likewise typically include a series or plurality of spaced apertures or 'onboard lazy kates' 80, each respective aperture 80 being sized to removably engage a spindle 85. Typically, a spindle 85 is operationally engaged to the frame assembly 15 and to the second pulley 25 for receiving and accumulating yarn.

The spindle assembly 17 further includes an armature assembly 90 that includes a pair of parallel or generally parallel 'flyer' arms 95 that are connectable to the frame assembly 15 to extend parallel or generally parallel to a connected spindle 85. Each arm 95 typically includes a plurality of typically evenly spaced pins or fingers 100 extending therefrom, and typically both arms connect to a base member or 'flyer' 105. Base member 105 includes two or more pairs of spaced apertures 107 to accommodate equidistant (relative to base member center) positioning of arms 95 having fewer, more widely spaced fingers 100 further apart from one another and equidistant (relative to base member center) positioning of arms 95 having greater numbers of less widely spaced fingers 100 closer together. Each pair of arms 95 thus has a uniquely finger spacing. The apertures 107 are threaded or the like such that the arms 95 are repeatedly removably connectable thereto and disconnectable therefrom.

The frame assembly 15 includes a transverse member 110 which connects to the elongated support members 65 and to an elongated front support member 115. The support members 65 and front support member 110 are positioned to generally define a tripod, generally converging upon the transverse member 110. Transverse member 110 also connects to lateral support member or 'mother of all' 120. First and second flat members or 'front and back maidens' 125 each connect at one end to opposite ends of lateral support member 120 and at opposite ends to spindle assembly 17 to define a working volume therebetween. A tensioner member 130 connects to front support member 115 and tensioner 35.

Spindle assembly 17 further includes a hollow tube member or 'orifice' 135 extending through first flat member 125 and connecting to the spindle 85, through which fibers and/or twisted yarn may be pulled toward the spindle 85. Spindle assembly 17 also typically includes a second cylindrical member 140 extending from the spindle 85 through the base 105 and engaging the second flat member 125. The cylindrical member 140 is rotationally connected to the second flat member 125.

Spinning wheel system 10 typically includes a number of interchangeable second pulley 25 discs of different diameters and each having at least one groove 40A formed therein to define a unique effective diameter, and more typically, a plurality of spaced grooves 40A, 40B formed therein to define a plurality of different effective pulley diameters. The pulley members 25 typically have a central aperture 150 that is threaded or likewise fitted to removeably engage the (typically matably threaded) spindle 85.

Apertures 80 may hold a plurality of spindles 85 or bobbins. Spindles 85 may hold spun yarn, and bobbins may hold fibers or threads to unwind for feeding into the orifice 135 to be twisted together to yield yarn.

In operation, the frame assembly 15 is deployed by connecting member 50 to pulley 20 and pedal 55 and connecting member 60 to members 65. Member 70 is likewise connected to members 65 via fasteners 75. Member 70 and fasteners 75 may be removed from the frame assembly 15 and reconfigured to act as a 'niddy-noddy' for winding yarn or the like. Second pulley 25 having the desired effective diameter as defined by groove 40A is engaged to spindle 85, and spindle assembly 17 is rotatably engaged to frame assembly 15 at members 125. Endless belt 30 is engaged to first and second pulleys 20, 25 and, typically, to tensioner 35. Fibers from a fiber source, such as a volume of wool, are directed into and through the orifice 135 and twisted together. The twisted fibers are directed into engagement with the arms 95 and fed onto the spindle 85.

For thin or skinny yarn, smaller diameter second pulleys 25 are engaged, arms 95 with more and closely spaced fingers 100 are engaged to base member 105 via a narrowly spaced aperture pair 107, and an orifice plug 160 may be inserted into the orifice 135. For thicker yarn, larger diameter second pulleys 25 are engaged, arms 95 with fewer and widely spaced fingers 100 are engaged to base member 105 via a widely spaced aperture pair 107, and the wider cavity of the orifice remains unplugged.

In another embodiment, some or all of the components of the spinning wheel assembly 10 as detailed above are provided separately as a kit.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A spinning wheel assembly, comprising:

a collapsible frame portion; and a spinning assembly operationally connected to the collapsible frame portion, further comprising:

a first grooved pulley rotatably connected to the frame portion;

a plurality of differently sized second grooved pulleys, each respective second pulley being rotatably connectable to the frame portion and spaced from the first pulley;

a spindle removably connectable to a respective grooved second pulley;

an endless belt operationally connected to the first and second pulleys;

a tensioner connected to the frame portion and operationally connected to the endless belt;

a base member operationally connected to the spindle and rotatably engaged to the frame portion;

a plurality of pairs of arms, each respective pair of arms being removably connectable to the base member;

a plurality of evenly spaced fingers extending from each respective pair of arms;

wherein each respective pair of arms has a unique finger spacing;

wherein each respective grooved second pulley has at least one circumferential groove defining an effective diameter;

wherein each respective second pulley has at least one unique effective diameter; and wherein only one respective second pulley may be rotatably connectable to the frame portion at any given time.

2. The assembly of claim 1 and further comprising a hollow orifice member defining an intake diameter and removably connectable to the frame portion for engaging the spindle; and at least one plug insertable into the hollow orifice member for decreasing the intake diameter.

3. The assembly of claim 1 and further comprising a series of apertures formed through the frame portion for engaging spindles and bobbins.

4. The assembly of claim 1 and further comprising a removable crossbeam member connectable to the frame portion to define a shelf and removable from the frame portion to define a skein.

5. A spinning wheel device, comprising:

a collapsible frame assembly, further comprising:

a transverse member;

a front support member connected to the transverse member;

a pair of oppositely disposed elongated support members pivotably connected to the transverse member;

a first crossbar member extendable between, and removably engagable to, the pair of elongated support members;

a second crossbar member connectable to the pair of support members to define a shelf;

a pedal member pivotably engaged to the first crossbar member;

a pedal engaging member connected to the pedal member and extending therefrom;

a lateral support member connected to the transverse member; and a pair of spaced spindle support members extending from the lateral support member and defining a working volume therebetween; and a spinning assembly operationally connected to the frame assembly, and further comprising:

a first circumferentially grooved pulley rotatably connected to the frame portion and operationally connected to the pedal engaging member;

a second circumferentially grooved pulley rotatably connected to the frame portion and spaced from the first pulley;

a spindle removably connected to the grooved second pulley;

an endless belt operationally connected to the first and second pulleys;

a tensioner connected to the frame portion and operationally connected to the endless belt;

a first armature assembly removably connected to the spindle and rotatably engaged to the frame assembly, wherein the armature assembly further comprises:

a base member;

a hollow cylindrical member extending through the base member for rotatably accepting the spindle and the rotatably engaging the frame assembly;

a pair of arms extending from the base member; each respective pair of arms being removably connectable to the base member; and a plurality of evenly spaced fingers extending from each respective arm;

wherein the diameters of the first and second circumferentially grooved pulleys define a first drive ratio;

wherein the first drive ratio defines the number of twists per unit length of yarn spun onto the spindle; and wherein the drive ratio determines the thickness of yarn spun onto the spindle.

6. The device of claim 5, wherein the second circumferentially grooved pulley has a first groove defining a first effective diameter and a second spaced groove defining a different second effective diameter.

7. The device of claim 5 and further including a third circumferentially grooved pulley exchangeable with the second circumferentially grooved pulley; and a second alternate armature assembly engageable with the base member and spaced from the first armature assembly; wherein the third circumferentially grooved pulley has a different diameter than does the second circumferentially grooved pulley and wherein the alternate armature assembly has differently spaced fingers than does the first armature assembly.

8. The device of claim 7 wherein the first and third pulleys define a different drive ratio than do the first and second pulleys.

9. The device of claim 5 wherein the spindle is a drop spindle.

10. A spinning wheel kit, comprising:

a first support member;

a first pulley rotatably connectable to the support member;

a second support member connectable to the first support member;

a plurality of second pulleys rotatably connectable to the second support member, wherein each respective second pulley defines a unique effective diameter;

an endless belt operationally connectable between pulleys;

a tensioner connectable to extend from the first support member to engage the endless belt;

a lateral support member engageable to the second support member;

a third support member spaced engageable to the lateral support member; and a base member having a plurality of pairs of arm-receiving apertures, wherein the base member is rotatable engageable to the third support member and rotatably engageable to a spindle;

a plurality of pairs of arms, wherein each respective pair of arms includes spaced fingers extending therefrom with the fingers on each respective pair of arms enjoying spacing distances unique to that respective pair of arms.

11. The kit of claim 10 wherein the first and second support members are unitary.

12. The kit of claim 10 and further comprising a spindle operationally connectable to the second pulley and operationally connectable to the base member.

13. The kit of claim 10 and further comprising:

a transverse member connectable to the first support member;

a lateral support member connectable to the transverse member and the second support member;

a third support member connectable to the lateral support member for defining am working space therebetween and for rotatably engaging an armature assembly;

a pair of legs, each leg connectable to opposing sides of the transverse member;

a first crossbar connectable between the legs; and a pedal pivotably connectable to the first crossbar and operationally connectable to the first pulley.

14. The kit of claim 13 wherein each respective leg has a plurality of apertures sized to receive a spindle.

15. The kit of claim 13 and further comprising a second crossbar connectable to the legs.

* * * * *